US007987651B2

(12) United States Patent
Beeland et al.

(10) Patent No.: US 7,987,651 B2
(45) Date of Patent: Aug. 2, 2011

(54) AUTOMATIC BALE WRAPPING APPARATUS

(75) Inventors: William D. Beeland, Savannah, GA (US); Daniel E. Riggs, Savannah, GA (US); Donald W. Van Doorn, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 62 days.

(21) Appl. No.: 12/211,242

(22) Filed: Sep. 16, 2008

(65) Prior Publication Data

US 2009/0229226 A1 Sep. 17, 2009

Related U.S. Application Data

(60) Provisional application No. 60/972,954, filed on Sep. 17, 2007.

(51) Int. Cl.
*B65B 7/08* (2006.01)

(52) U.S. Cl. ..... 53/284; 53/481; 53/370.6; 53/371.7; 53/372.7; 53/375.7; 493/156; 493/260; 493/311

(58) Field of Classification Search ..... 53/469, 53/481, 482, 284, 370.6, 371.7, 371.9, 372.2, 53/372.7, 372.5, 375.2, 375.7; 493/156, 493/157, 260, 311

See application file for complete search history.

(56) References Cited

U.S. PATENT DOCUMENTS

| | | | | | |
|---|---|---|---|---|---|
| 2,514,620 | A * | 7/1950 | Ashe | 53/370.6 |
| 3,078,633 | A * | 2/1963 | Stromberg et al. | 53/370.6 |
| 3,115,736 | A * | 12/1963 | Peterson | 53/370.6 |
| 3,411,268 | A * | 11/1968 | Long | 53/370.6 |
| 3,852,937 | A * | 12/1974 | Bitsura et al. | 53/442 |
| 3,864,894 | A * | 2/1975 | Sheetz et al. | 53/506 |
| 3,949,537 | A * | 4/1976 | Jason et al. | 53/226 |
| 4,023,330 | A * | 5/1977 | Williams | 53/370.3 |
| 4,071,999 | A * | 2/1978 | Nolet | 53/370.4 |
| 4,594,836 | A * | 6/1986 | Good | 53/459 |
| 4,945,715 | A * | 8/1990 | Brodrecht | 53/567 |
| 5,234,398 | A * | 8/1993 | Larsen | 493/183 |
| 5,425,221 | A * | 6/1995 | Pronovost et al. | 53/567 |
| 5,628,168 | A * | 5/1997 | Inman et al. | 53/567 |
| 6,050,056 | A * | 4/2000 | Weisser et al. | 53/370.6 |
| 6,050,066 | A * | 4/2000 | Brodrecht | 53/576 |
| 6,343,459 | B1 * | 2/2002 | Seaward et al. | 53/434 |
| 6,871,481 | B2 * | 3/2005 | Scaliti et al. | 53/464 |
| 6,881,180 | B2 * | 4/2005 | Ammons et al. | 493/183 |
| 7,013,625 | B2 * | 3/2006 | Curles | 53/571 |
| 7,021,029 | B2 * | 4/2006 | Hannen et al. | 53/459 |

* cited by examiner

*Primary Examiner* — Hemant M Desai
(74) *Attorney, Agent, or Firm* — Smith, Gambrell & Russell

(57) ABSTRACT

Apparatus is disclosed for enclosing bales of materials with at least four substantially rectilinear sides in flexible sheet material tubes having one open end into which the bales are inserted leaving the tube open end projecting loosely beyond the end of the bale utilizing structure temporarily placed inside the tube open end tending to resist inward movement of said tube such that the tube end may be formed into pleats at the four corners of the end of the bale and structure external of the tube cooperating to form and fold the pleats against the bale end surface where they are affixed.

18 Claims, 3 Drawing Sheets

AUTOMATIC BALE WRAPPING APPARATUS

RELATED APPLICATION

This application claims priority to U.S. provisional application No. 60/972,954, filed Sep. 17, 2007, which is incorporated herein by reference.

BACKGROUND

In the field of cotton ginning, which is the process of separating the cotton fibers from the seed, the fibers known as lint have for many years been compressed into six-sided rectilinear bales and partially covered or fully covered with various bagging materials and held together with ties of various sorts. Over the many years, the baling of cotton lint has evolved from primitive baling presses and manual tying and wrapping to fully automated higher capacity and higher density presses with fully automated bale-tying systems. A further significant development is the system in which the bale is formed and the ties are applied in the press and the naked bale is conveyed from the press where the bale cover is applied external of the press. A common system used to apply the bale cover to the bale employs a simple device called a bale bagger which consists of two vertically hinged metal half-sleeves that, when pivoted close together, allow open-ended bags of bale wrapping material to be manually placed over the two sleeve halves such that the two sleeve halves act as shoe horns when the bale is pushed between the hinged sleeve halves to snugly apply the open-ended bag over the bale after which the open end of the bag is manually folded over the bale end and permanently fastened closed by various means.

While this bale covering system has released the press from much automated high-capacity operation, due to its present state it requires significant labor to manually move the individual bale bag covers from their incoming layered stacks and manually apply the open end of the bags over the pairs of sleeve segments of the bagger, which requires two operators, one on each side of the bagger. Furthermore, the closing of the open end of the bag requires additional labor and results in various degrees of bag closure quality.

Recently, open-ended bags lightly attached in continuous roll form have proven to be satisfactory bale covers and they are very price competitive. These rolls of frangibly attached continuous individual bale covers lend themselves well to automation. The present invention introduces novel concepts that, taken together, provide essential elements for a fully automated, efficient and quality bale cover application system.

OBJECT OF THE INVENTION

An object of the present invention is to minimize labor required to apply bale coverage to six-sided rectilinear bales. A further object of the present invention is to provide an automated bale cover application system that results in a professional finished bale appearance. Yet another object of the present invention is to provide an automatic bale cover applying system in which all six sides of the bale are fully covered. A still further object of the present invention is to provide an automatic bale covering system that can operate at sufficient capacity (bales per hour) to meet the needs of high-capacity ginning operations. An even further object of the present invention is to automatically apply bale covers to bales and accumulate the bales in rows for manual or powered equipment to efficiently move the covered bales to subsequent storage or shipment. Another object of the present invention is to provide in-process means to accommodate bale measurement of weight and quality factors.

DESCRIPTION OF THE DRAWINGS

The accompanying drawings form a portion of this disclosure depicting a preferred embodiment of the invention wherein.

DESCRIPTION OF A PREFERRED EMBODIMENT

Figure 1:
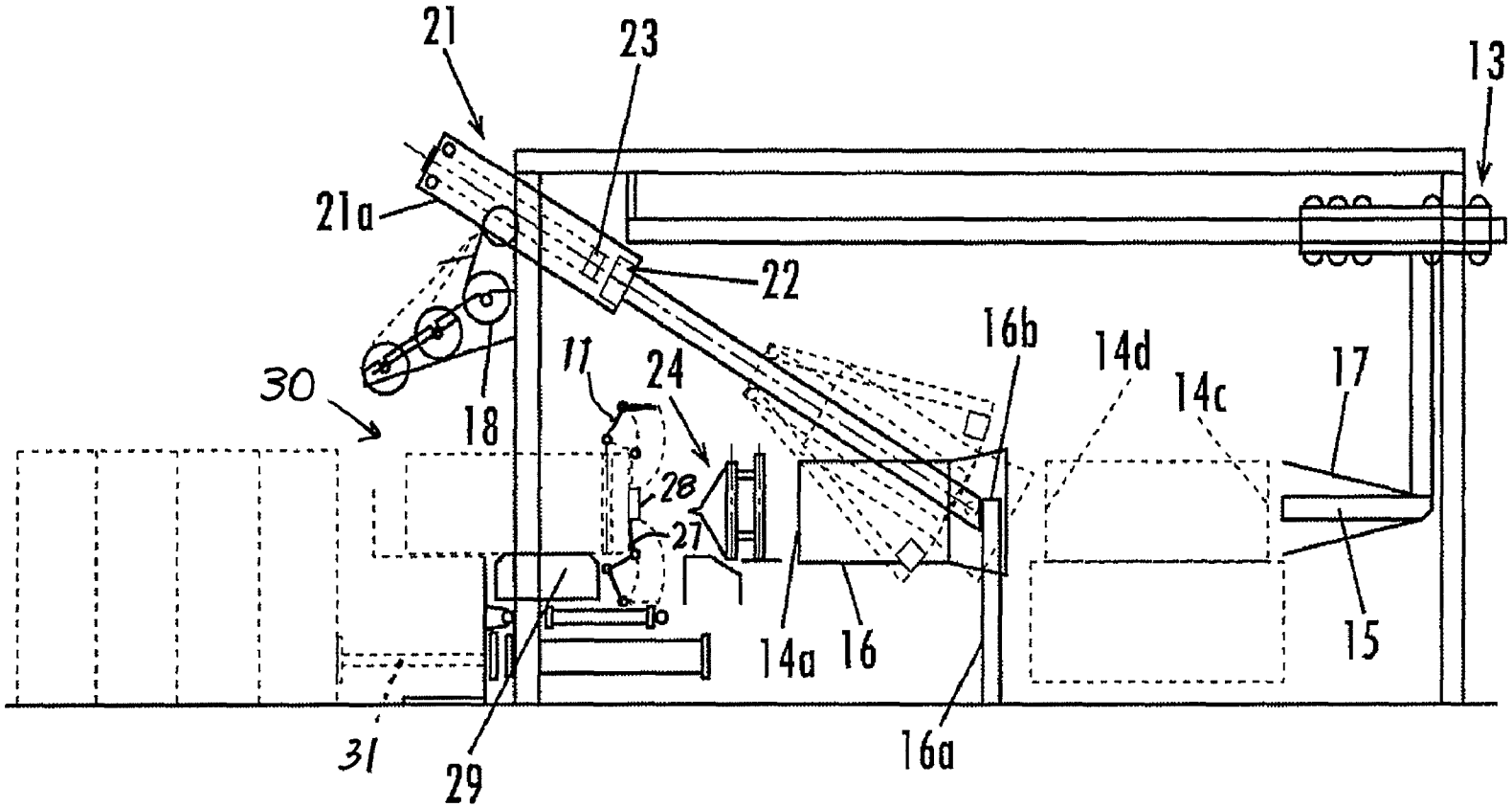
FIG. 1 is an overall side elevation view of an automated bale bagging system generally illustrating the concepts of the present invention.

It should be understood that the elements of this invention may be used in various systems in which uncovered bales are introduced for the application of automatically applied bale covers employing the novel principles of our patent claims. In a preferred embodiment, the apparatus of the present invention would be associated directly with the output of a baling press 10 as shown in FIG. 1, in which the bale 14, shown in phantom, is fully compressed and bale ties are applied to the naked bales within the press. The uncovered bale 14 is automatically ejected from press 10 onto a powered dolly 12 or a conveyor such as conveying chains that delivers bale 14 onto a support table aligned with a powered bale pusher 13 for movement by the pusher perpendicular to the bale movement from the press 10. Where a powered dolly is used the dolly platform may serve as the table. Bale pusher 13 may be electrically or hydraulically powered in any conventional manner suitable for use in a bale processing environment.

Six-sided bale 14 has four substantially flat sides 14*a*, 14*b*, 14*c* and 14*d* and two sides 14*e* and 14*f* that may be somewhat crowned. As bale 14 is ejected from press 10 and transferred to the table or platform, the bale rests on the table on one of its four flat sides with two of the other three flat sides standing vertical, parallel to the movement of the bale from the press to the table. The other flat side is the top of the bale as it lies on the table. The two sides that may be crowned are standing generally vertical, with one side facing the press and the other side facing away from the press as the bale lies on the table.

Figure 2:
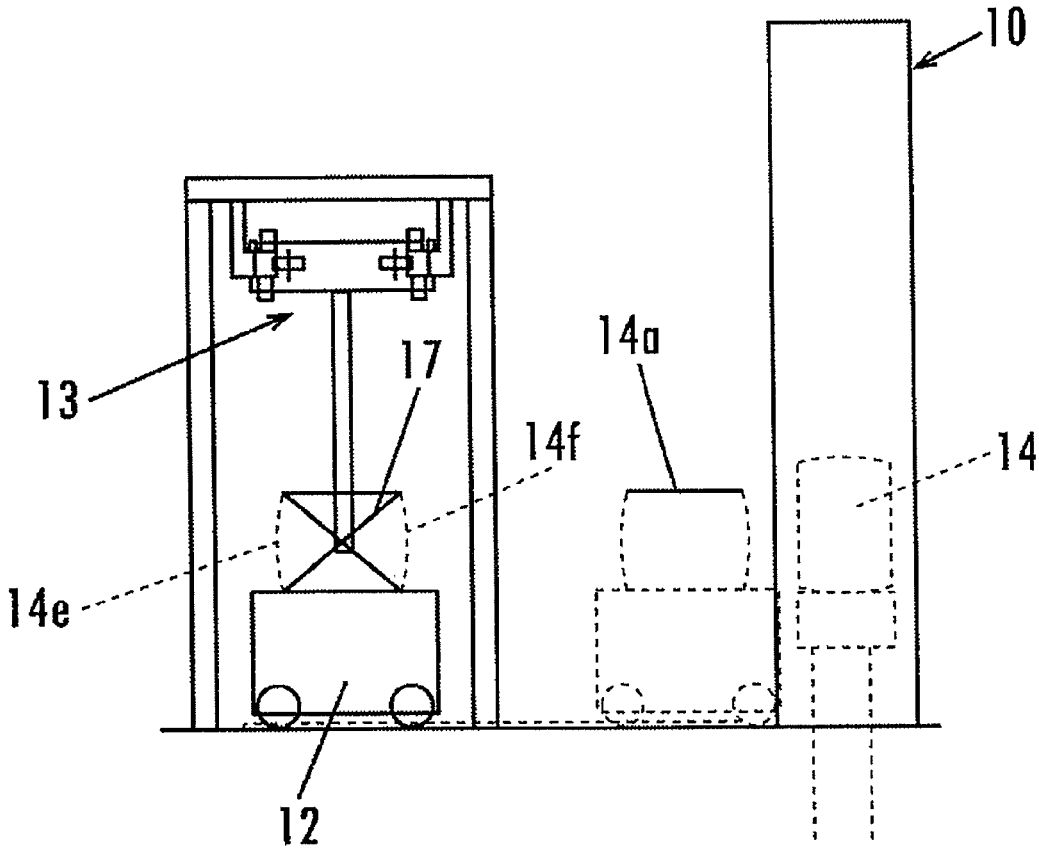
FIG. 2 is an partial end view of the apparatus.
Figure 3:
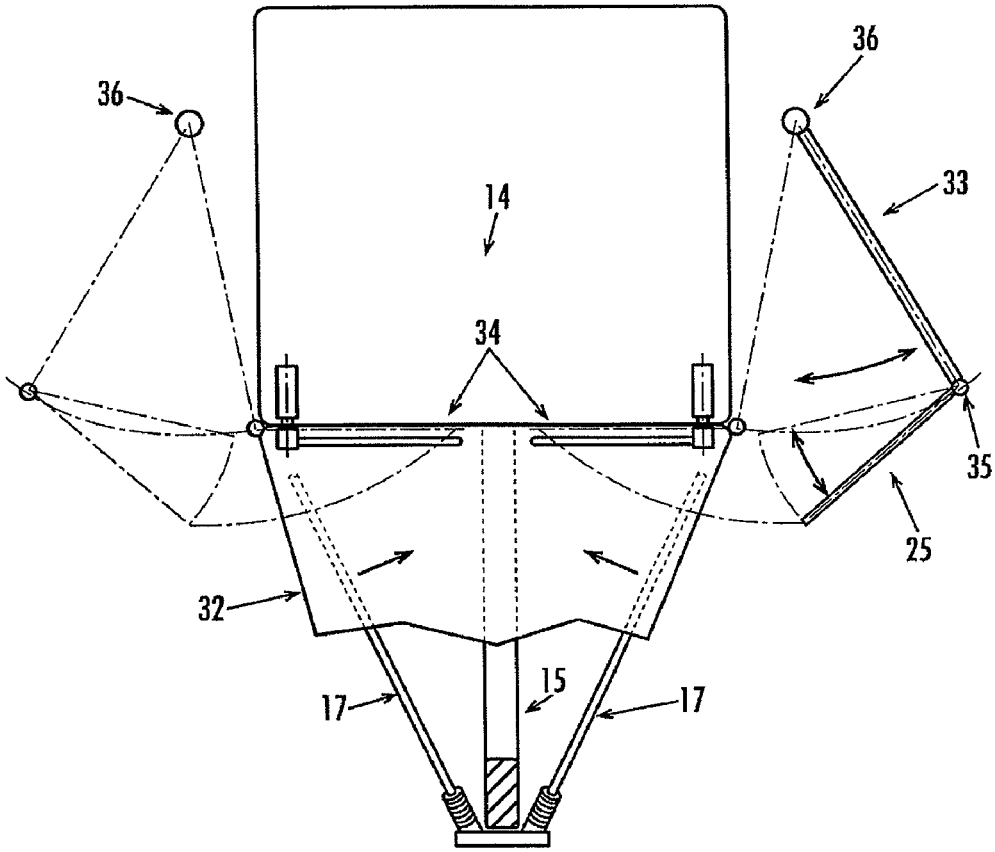
FIG. 3 is more detailed plan view of the initial folding apparatus.
Figure 4:
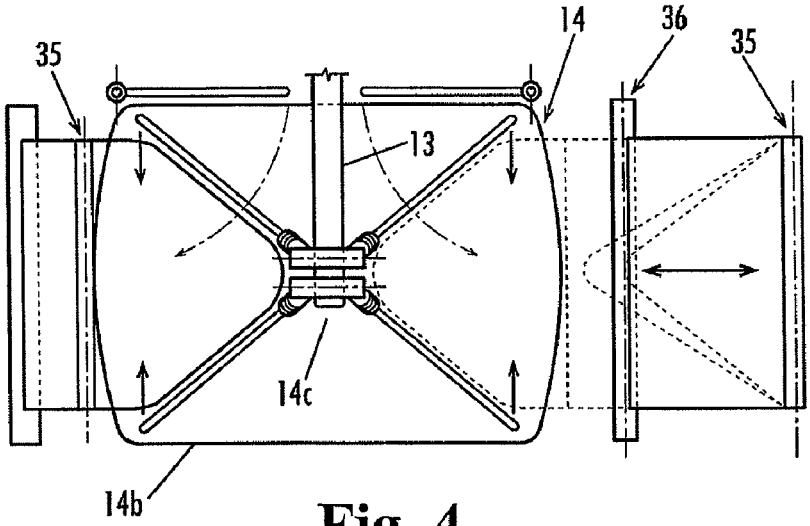
FIG. 4 is an end view of the initial folding apparatus.

As seen in FIGS. 1 and 2, powered bale pusher 13 has an extended arm 15 positioned horizontally and directed approximately at the center of one of the flat vertical sides 14*e* of the bale. The end of the pusher arm 15 has a defined face large enough to move the bale horizontally without deforming the end 14*e* of the bale, but limited so as not to interfere with subsequent bale wrap end closure functions. Near the side of the bale 14*f* opposite the side facing the pusher arm just described, are two facing half-sleeves 16 that act like two shoe horns over which a tube of flexible wrapping material 30 may be placed when the two "shoe horn" sleeves 16 are pivoted toward each other. At least one of sleeves 16 is pivotally mounted to supports 16*a* such that the distal ends 16' are free to pivot away from each other, that is to say at least one of the distal ends is free to move away from the other. When tubular wrapping material 30 is placed over the sleeves, the sleeves facilitate placement of the tubular wrapping material about the bale when the bale is pushed between the sleeves from their proximal ends as described hereinafter. As will be understood a moving bale will urge sleeves 16 to pivot apart at their distal ends 16', tightening the tube of wrapping material over the sleeves while allowing bale 14 to be pushed between the two sleeves and emerge beyond the sleeve 16, thus placing the tubular wrapping material tightly over the bale. The expanded sleeves tend to hold the wrapping material to cause the bale to fully seat in the closed end of the tubular wrapping material.

The tube of wrapping material with its closed end is of a length to allow enough wrapping material to overhang the open end of the bale as the pusher arm pushes the bale beyond the pivoted sleeves to later form overlapping closure of the wrapping material over the end of the bale. It will later be seen that apparatus 17 mounted on the pusher arm structure that passes inside the pivoted sleeves along with the pusher arm and pass inside the overhanging wrapping material, will be instrumental in the formation of the closure of the wrapping material over the bale end.

In this preferred embodiment, an important element is the mechanism 21 to receive segmented tubular bale wrapping material automatically from a compact roll 18 and mount the open end of the individual wrap segments over the pair of facing pivoted sleeves 16 described earlier. In this embodiment, the apparatus 21 for receiving the wrapping material in roll form is mounted over a line extending through the center of the bale as the bale passes through the pivoted sleeves 16 and continues in a straight horizontal line through the bale wrap closure apparatus 21 to be described hereinafter. Apparatus 21 includes tubular wrap clamping elements 22 that move with a carrier 21*a* from their position over the bale center line downward at an angle approximately 30 degrees from horizontal toward the pivoted sleeves. Movement of the carrier 21*a* may be accomplished with a hydraulic or electric drive system. The pivoted sleeves 16 additionally are mounted in an assembly 16*b* for selective pivotal movement about a horizontal axis near the proximal ends of the sleeve and transverse to the trajectory of the bale. The sleeves move angularly upward from horizontal to align with the downward angular movement of the bale wrapping material apparatus 21 that applies the open end of the tubular bagging material concentrically over the pivoted sleeves.

The clamping members 22 are mounted respectively above and below the flattened tubular wrapping material to firmly individually grip the two layers of wrapping material when the apparatus 21 is in its upward position along its 30 degree inclined movement. Clamping members 22 may comprise a set of pinchers for each grip point on the material or a suction connection, or any suitable device which is capable of moving the layers of the tubular wrapping material 30 apart. Choice of exact clamping means will depend on the nature of the wrapping material. At this clamping position, the wrapping material is clamped near the open end of the individual bale wrap, and the continuous roll of frangibly attached bale wrap segments is intact with the roll 18 free to turn.

Starting with the bale wrap receiving and delivering apparatus 21 in this upper position with the bale wrap gripped near its open end, the wrap receiving and delivery apparatus may move downward along its 30 degree inclined track when the bale pusher 13 is in its withdrawn position and the pivoted sleeve assembly 16 has pivoted upward to its upward inclined position aligned with the 30 degree downward track of the wrap delivery apparatus 21 As the wrap delivery apparatus grippers 22 pull the continuous frangibly joined segments along the downwardly inclined track, a sensor mounted on the stationary framework of the wrap delivery apparatus senses when the weakened line across the wrap tube between segments passes the sensor and a secondary wrap gripper 23 mounted on the stationary frame clamps the wrap material a pre-determined distance after the weakened line passes the secondary gripper. As the primary grippers 22 continue to move downwardly, the frangible line across the wrap tube ruptures, and the wrapping tube segment gripped at its open end continues to move. Before the open end of the wrap tube segment reaches the upwardly angled sleeve assembly 16, the grippers 22 near the open end move apart, thus forming the tube open end into a rectangular opening that fits loosely over the pivoted sleeves 16 that are powered closely together at this point. When the primary grippers 22 have fully drawn the wrap tube segment onto the pivoted sleeve assembly 16 the grippers release the wrap tube and the pivoted sleeves 16 are powered to open position, tightening the wrap tube about the sleeves 16. The primary grippers 22 of the wrap delivery apparatus 21 then reverse their movement and return to their upper position. As the grippers 22 approach their upper position, they pass over the trailing wrap tube segment open end, a short distance from the secondary grippers 23 still holding the following wrap segment. At the upper position, the primary grippers 22 move close together and grasp the following segment two tube layers respectively and the secondary grippers 23 release the wrap tube. The wrap receiving and delivery apparatus 21 is now ready to deliver the next bale wrap tube segment to the pivoted sleeve assembly 16

As soon as the primary grippers 22 of the wrap receiving and delivery apparatus 21 move away, clear of the pivoted sleeve assembly 16, the sleeve assembly 16 is rotated down from alignment with the wrap delivery apparatus 21 to its horizontal position in alignment with the bale pusher assembly 13 to await the next bale to be inserted in the tubular wrap mounted over the sleeves 16.

At this point, the bale pusher 13 moves against the end of the bale to horizontally move the bale into the pair of pivotable sleeves 16 over which the previously described bale wrap tube is now tightly placed. As the bale is pushed through the pivoted sleeves 16, it may force the pivoted sleeves even more tightly against the bale wrap tube. As the bale leading end emerges from between the pivoted sleeves air is entrapped, ballooning out the sealed closed end of the wrapping tube. To control this air pressure build-up, the pivoted sleeves 16 have a lengthwise air vent or groove leading from end to end of the sleeve to allow controlled exhaust of air trapped between the tubular wrap closed end and the advancing bale end. The friction of the pivoted sleeves 16 pressing tightly inside the bale wrap tubing overcomes the controlled air pressure build-up between the leading end of the bale and the closed end of the bale wrap tube such that the leading end of the bale firmly seats against the sealed wrapping tube end.

However, when the simplest form of flattened tube material is used with a single layer seam from side to side of a simply flattened tube, a surplus of wrapping material will project out of either side of the bale at the closed end of the bagging material. These are known as "rabbit ears", which detract from the appearance of the bale wrap and expose loose wrap material vulnerable to snagging. Therefore, in a preferred embodiment of the present invention, a mechanism 24 is provided to tuck the rabbit ears under the outer layer of bagging material covering the bale end. This mechanism is most effectively applied as the bale is pressed into the tubular bagging and the previously mentioned air pressure causes ballooning out of the rabbit ears just before the leading end of the bale is tightly pulled against the sealed end of the tubular bagging. Such a mechanism to fold said ears under the single seam includes means coordinated with said apparatus as it inserts the bale into the wrapping material such that this means moves a leading surface against the "ear" of wrap looseness generally in a direction parallel to the single seam and parallel to the plane of the bale leading end face, contacting the ear near the end of the seam just before the bale end tightens against the seam, thus to tuck the ear between the bale end and the outer wrapping material and withdraw as it tightens against the bale end at said seam as the bale is fully inserted in the tube of wrapping material.

In a preferred embodiment, these actions are accomplished by apparatus 24 mounted respectively on either side of the bale downstream of pivoted sleeves 16. Apparatus 24 is mounted on two fixed vertical pivot shafts a short distance from the sides of the bale. On these pivot shafts are mounted powered pivoting arms on which, in turn, are second pivots parallel to the first mentioned pivot shafts. Projecting from second pivots are thin plates whose pivoting motion, relative to the arms, is limited to a maximum "V" configuration inside angle relative to the arms. The thin plate shape is a symmetrical triangle with the base adjacent the second pivot. The point of the symmetrical triangle projecting out away from the second pivot may be very sharp to pierce the bale wrap material to release air entrapped between the bale and the ballooned out end of the wrapping material or a piercing projection may be formed on the plate near the base to avoid tearing of the material. The combination of the location of the initial pivot shafts relative to the bale location and movement as the bale is pressed into the tubular wrapping material, and the length of the aforementioned pivot arms and the height of the symmetrical triangular thin plates, and the limited maximum "V" relationship of the pivot arms and the thin plates and the coordination of the powered pivoting of this apparatus around the initial pivot shafts causes the sharp point of the thin triangular plates to contact the ballooned out rabbit ears near the ends of the single seal of the closed end of the tubular wrapping material to force the ends of the seal inward of the rabbit ears through an arc, ending with the end of the seal laying against the end of the bale with the triangular plate laying substantially flat adjacent the bale end with the tubular wrap end seal folding back on itself such that the outer layer of the tubular wrap lies close to the bale end with the rabbit ears tucked under the outer layer of wrapping material. These respective pivoting apparatuses are then quickly rotated reverse to the original rotation to withdraw the triangular plates from the bale end. In this action, the second pivots allow the triangular plates to substantially remain parallel to the bale end, and the location of the bale end to this apparatus in combination with the length of the aforementioned arms pivoting on the initial pivot shafts are designed to allow the triangular plates to withdraw without significantly disrupting the snugly laying wrap material against the bale end.

As the bale pusher arm 15 continues to move the bale horizontally in a straight line, the trailing end of the bale passes the ends of the pivoted sleeves 16, leaving a predetermined length of bagging material 32 hanging loosely over the trailing end of the bale. However, mounted on the pusher apparatus is a previously mentioned structure 17 that passes through the pivoted sleeves with the pusher arm 15 and now lies inside the loose open end of the bagging material tube. This structure 17 preferably has four rod-like arms, that when unrestrained at their free ends, are located close to the trailing bale end respectively at each of the four corners of the bale. These rod-like structures 17 converge with increasing distance from the bale trailing end and are angularly yieldably mounted close to the pusher arm 15. Further, these rod-like structures may be powered for interactive movement by either hydraulic or electric motors, not shown, which control, the deflection of the rod like structures.

As the pusher 13 continues to move the bale with its tubular bale wrap tightly covering five of the six sides of the bale and with the wrap loosely overhanging the trailing sixth side of the bale, the bale movement may be coordinated with two vertically pivoted wrap forming surfaces 25 on either side of the bale generally triangularly shaped such that as the bale moves, the vertically pivoted wrap forming surfaces rotate around the respective bale side trailing edges to snugly urge the bale cover material against the trailing end of the bale over triangular areas roughly forming the inside areas of triangular pleats that start at the corners of the bale and widen toward the center of the bale end. The formation of the pleats results from not only the coordinated movement of the bale with the rotation of the wrap forming surfaces, but also results from the rod-like structures 17 inside the overhanging bale cover material that concurrently roughly form the outside edges of the expanding pleats starting at the bale end corners.

The initial forming of the bale end pleated closure may also be formed after the bale pusher 13 has pushed the bale into its final position for bale end wrap closure application. With this option, the initial formation of the wrap pleated folds employs two vertically pivoted folding surfaces 25 in which the vertical pivots 36 are respectively located along the sides of the bale a pre-determined distance from the open end of the bale. The respective triangular wrap forming surfaces are mounted on arms 33 approximately the pre-determined distance long with the folding surfaces projecting from the arms in a direction forming roughly an "L"-shape from the arms such that as the pivoting arms are rotated from positions out of alignment with the bale end to folding positions, the folding surfaces engage the wrapping material with a motion that sweeps the loosely hanging wrapping material toward the center of the bale end winding up with the folding surfaces lying flat against the bale end and the pivot arms just clearing the sides of the bale. In this action, the rod-like structures 17 inside the wrapping material cause the material to roughly form the outside fold of expanding pleats starting at the corners of the bale while the triangular pivoting folding surfaces 25 are roughly forming the inside folds of the expanding pleats.

In close following movements, pivoted wrap folding surfaces 11 and 27 pivoted over the top of the bale and under the bottom of the bale in turn urge the wrapping material overhanging the top edge and bottom edge of the bale end to, in succession, partially fold in overlapping relationship. This latter action is accompanied with the withdrawal of the bale pusher arm 15 from the bale end which also moves the rod-like structures 17 to withdraw, during which the rod-like structures being angularly flexibly mounted to the pusher arm structure will yield to the force of the wrap material roughly forming the outside pleat folds, thus to tension the wrapping material into tighter pleats as the pusher arm 15 and associated rod-like structures 17 pull away from the partially formed wrap pleats. This action may be enhanced by further powered movement of the rod-like structures 17 in which the two upper angled rods are powered angularly downward and the two lower rods are powered angularly upward sequentially to overlap the bale wrap material as the bale pusher arm 15 and the associated rod-like structures 17 pull away from the bale end.

To further assist in assuring the bale wrap end closure is made with neatly folded overlapping layers of wrapping material, a pair of horizontally pivoted, rod-like arms 34 may be mounted with their pivots just above the top of the bale and parallel to the bale movement into the wrap closure station with their pivot centers respectively equally distant from opposite sides of the bale movement center line. These pivoted arms 34 initially lie horizontally, facing each other, out of alignment with the bale as it moves into the wrap closure station. After the folding operations just described have been completed and the pusher arm (5) has been withdrawn, these pivoted arms may be powered to rotate downward in opposite rotational directions, sweeping across the bale end face such that the arm pivoted on the right side of the bale center line will rotate counter-clockwise to sweep down and to the right while the other arm sweeps clockwise down and to the left to cause the wrap material projecting down over the top end edge of the bale to lay flat against the bale end. These arms may continue their respective rotations to move out of alignment with succeeding operations.

Concentrically pivotally mounted with the horizontally pivoted folding mechanism 27 pivoted under the bale is a heat-sealing device 28 positioned to thermally seal the overlapping bale wrapping material projecting down from the upper bale edge and the wrapping material projecting upward from the bottom bale edge in which the previous actions sequentially cause the wrapping material projecting downward from the top of the bale to be under the overlapping material projecting upward from the bottom of the bale, thus when the pivoted wrap forming surfaces 11, 25 and 26 in conjunction with the pivoted thermal sealing device 28 are fully actuated to firmly press against the bale end, entrapping the overlapping wrapping material, the heat sealing device 28 bonds the overlapping layers of wrapping material to form a neatly pleated bale end closure.

At this point, the bale wrapping material enclosure is complete, but the folding surfaces vertically pivoted to form the initial interior folds of the expanding pleats are lying flat against the bale end, and they are partially lying under the expanding pleat outer creases. In our embodiment in which these two vertically pivoted folding surfaces 25, previously described as having folding arms of pre-determined length on which are mounted the generally triangular-shaped folding surfaces mounted at an "L"-shaped angle from the folding arms, the folding arms have second pivots 35 at or near the juncture of the folding arms and the folding surfaces. The pivoting action of the second pivots allows free angular movement only to decrease the inside angle of the "L" between the folding arms and the folding surfaces. This pre-determined distance between the initial pivot and the secondary pivot and the maximum allowable angular movement of the folding surface relative to the folding arm is such that when the folding arm and folding surface initially fold the wrapping material overhanging the side edges of the bale end, the final closed position of the folding surface is flat against the bale end and the folding arm clears the bale side. But further, the location of the initial pivot and the distance from the initial pivot to the secondary pivot just described is such that as the initial pivot rotates to withdraw the folding surface from the end of the bale, the second pivot initially moves substantially parallel to the end face of the bale. The second pivot, being free to decrease the angle between the folding surface and the folding arm, allows the folding surface, which may be very thin, to withdraw from under the overlapping folding material without substantially disturbing the tightly folded, pleated and sealed wrapping material enclosing the end of the bale.

At this stage, all the bale wrap enclosure apparatus may be withdrawn and the bale may be weighed since the bottom platform in the folding station is also the weighing scale platform 29.

The bale pusher 13 may have immediately moved all the way back to its fully withdrawn position when it and its associated pivoted rod-like structures 17 had initially withdrawn from the bale end face. This allows the next bale to move from the baling press 10 into alignment with the pusher arm 13 and the pivoted sleeve assembly 16 to rotate upwardly at about a 30 degree angle to align with the bale wrap receiving and delivery unit 21 which can immediately pull the open end of the next segment of bale wrapping tube material downward at its thirty degree angle from horizontal. At this time the wrap clamping mechanism 22 is actuated to its secondary function which is that of grasping the external surfaces of the two layers of the tube of wrapping material and pulling the two layers apart at positions near the open end of the flattened tube of wrapping material such that the wrapping material open end is formed into a generally rectangular opening to freely pass over the pair of pivoting sleeves 16 which have now moved to their closed positions. Thus, the cycle has been completed and the cycle of the next bale covering operation has begun.

To even further allow independent movement of the bale wrapping functions and the baling press, the bale pusher 13 may have a horizontal pivot 37 parallel with its movement and located at its upper end such that when this pivot is power actuated to rotate the pusher arm about ninety degrees, the pusher arm swings up and out of alignment with the bale and pivoted sleeve assembly 16, thus to allow succeeding bales to move from the press 10 and into the initial bale insertion position before the pusher 13 has returned to its fully retracted position.

If the bale pusher 13 immediately returns to its initial retracted position after the first stages of the bale wrap end closure involving the bale pusher arm have been completed, the bale resting in the bale wrap enclosure station will wait for the subsequent bale to push it onto the down-ender 30 station. The down-ender will then pivot the bale downward to stand it on its head on a smooth floor plate. A horizontal floor level pusher 31 will push the bale away from the down-ender to make way for the next bale. The bale floor level pusher 31 will continue to accumulate bales stacked together on their heads until powered clamp trucks or other means move the bales singly or in groups to storage or transport vehicles.

This completes the description of the main features of a preferred embodiment of our invention.

What we claim is:

1. Apparatus for enclosing bales of materials with at least four substantially rectilinear sides in which flexible sheet materials are pre-formed into tubes having one open end into which the bales are inserted leaving the tube open end projecting loosely beyond the end of the bale, comprising:

a. A receiving station for receiving a bale from an associated bale source, said receiving station including a table aligned with a powered bale pusher positioned to urge said bale along a linear path extending beyond said table, b. opposing powered sleeve segments mounted for selective concomitant positioning between an aligned position along said linear path and a retracted position offset from said linear path, said sleeve segments receiving said bale therein at said position along said linear path and receiving a preformed tube externally thereon at said retracted position;

c. a tube positioning apparatus including a reciprocating carriage, selectively moveable along a line offset from said linear path and passing through said retracted position, and a set of grippers mounted on said carriage for selective engagement with said tube open end to position said open end over said sleeve segments at said retracted position;

d. electric control apparatus that signal said sleeve segments to move to said retracted position during the operation of positioning said tube open end over said sleeve segments and to said aligned position prior to said powered bale pusher arm moving the bale into said sleeve segments; and, e. a tube end folding station mounted along said linear path and including a plurality of articulated arms engaging and closing said tube about said bale after said bale is urged through said sleeve segments, wherein said control apparatus coordinates movement of said bale pusher and said sleeve segments such that a successive tube is positioned on said sleeve segments while said bale remains in said tube end folding station and said bale pusher returns to said receiving station.

2. Apparatus as in claim 1 further comprising four rod-like structures mounted on said powered bale pusher arm with free ends thereof extending toward the four corners of said bale end and which pass inside said separated sleeve segments as the bale pusher arm moves the bale through said sleeve and remain inside the tube open end as the pusher arm pushes the bale past said separated sleeve.

3. Apparatus as in claim 2 in which said four rod-like structures are yieldably mounted on said pusher arm distal an end of said pusher arm which engages said bale to form a yieldable frame loosely defining the outer folds of a plurality of pleats in said sleeve.

4. Apparatus as defined in claim 1 wherein said electric control apparatus is operatively connected to said powered sleeve segments to signal said powered sleeve segments to move from a closed position to a separated position while in said retracted position such that said sleeve segments engage the inside of said tube to retain said tube thereon and free said reciprocating carriage and grippers to retract from said segments.

5. Apparatus for enclosing bales of materials with at least four substantially rectilinear sides in which flexible sheet materials are pre-formed into tubes having one open end into which the bales are inserted leaving the tube open end projecting loosely beyond the end of the bale, comprising:

a. insertion means for urging said bales into said tubes including opposing pivotally mounted sleeve segments over which said tube open end is placed, aligned with a powered bale pusher arm that contacts the bale end, pushing the bale into said sleeve segments urging the sleeve segments to separate such that the tube is transferred onto and over the bale as the powered bale pusher arm moves the bale along a path through and beyond the sleeve segments while leaving sufficient tube open end projecting loosely beyond the bale end to cover the bale end, means inside of said tube open end, associated with insertion means and having outward surfaces tending to resist inward movement of said tube such that areas of said tube may be formed into pleats starting at the four corners of the end of the bale;

b. means external of said tube cooperating with said means inside said tube to form said pleats and fold said pleats against the bale end surface, said pleats extending from opposite parallel sides of the bale overlapping when folded against said bale end surface including pivotally mounted arms on opposite sides of said path wherein said arms pivot about a first axis parallel to and offset from an adjacent side of the bale, each arm carrying a surface pivotally mounted along a second axis parallel to said first axis such that movement of said surface relative to said first and second axis engages tube at an oblique angle to the bale end face, urging the loose tube overhanging the bale end to draw snugly about the bale and against said means inside said tube; and, c. means to affix said pleats.

6. Apparatus as in claim 5 in which said arm and said surface define an "L", wherein the inside angle of the "L" is restricted from increasing but free to decrease, the location of said second axis defined to cause the second axis to move through an arc substantially parallel to and aligned with the end face of said bale to allow said surface to be withdrawn from the bale end face without substantially moving perpendicular to the bale.

7. Apparatus as defined in claim 6 in which said surfaces on said arms are contoured to form the inside folds of said pleats starting at the bale end corners as the folding surfaces engage the wrapping material at said oblique angle.

8. Apparatus as in claim 7 in which said arms and surfaces work in cooperation with said means inside said wrapping material to initially form said inside and outside folds of said pleats starting at the bale end corners, said surfaces remaining substantially closed against said bale end while said means inside the wrapping material withdraws leaving said outside folds substantially intact.

9. Apparatus as defined in claim 8 including two pivoted rod-like arms, the pivot axes substantially parallel to each other and perpendicular to said bale end face and located proximate said bale top surface and spaced apart equidistant from the vertical centerline of the bale at the bale end face, said rod-like arms, when activated, rotate in opposite angular rotational directions from their inactive positions optimally out of alignment with the bale top surface and end face such that said rod-like arm pivoted to the right of said vertical centerline rotates counter-clockwise across the bale end face and proximate the face urging the bale wrapping material downwardly and to the right of said bale centerline to lay closely against the bale end simultaneously with said rod-like arm to the left of said bale vertical centerline rotating clockwise to likewise cause the bale wrapping material to the left of the bale centerline to lay closely against the bale end.

10. Apparatus as defined in claim 8 further including folding means, pivoted over the top side of the bale in which the pivot is parallel to the bale end face and positioned a distance from the bale end parallel to the top surface of the bale in combination with a folding arm preferably "L"-shaped to reach around the bale upper end edge as a folding surface attached to said folding arm engages the upper tube 1 overhanging the bale end to draw it snugly down over the bale upper end edge and lay it flat against the bale end.

11. Apparatus as in claim 10 in which said pivoted folding means has a second pivot on said folding arm parallel to the first pivot described in claim 10, said second pivot restricted to rotation within a predetermined angle such that the angular movement between said folding arm and said folding surface is free within said predetermined angle but blocked from movement greater than the predetermined angle, said first pivot is further positioned relative to the bale end and relative to said second pivot such that when said first pivot rotates to withdraw said folding surface from its position laying said wrapping material flat against the bale end, said folding surface will withdraw substantially parallel and proximate to the bale end surface, thus to avoid conflict with overlaying wrapping material or overlaying essential equipment.

12. Apparatus as in claim 8 including folding means pivoted under the bottom of the bale in which the pivot is parallel to the bale end face and positioned a distance from the bale end and a distance below and parallel to the bottom surface of the bale in combination with a folding arm, preferably "L"-shaped to reach around the bale lower end edge as a folding surface attached to said folding arm engages the lower tube overhanging the bale end to draw it snugly up over the bale lower end edge and lay it flat against the bale end.

13. Apparatus as in claim 8 in which said means to affix said overlapping wrapping material is coordinated with said folding means such that when said folding actions have folded said wrapping material in pleated, overlapping position against the bale end, the affixing means moves into final position against the overlapped wrapping surfaces and affixes adjacent wrapping material layers.

14. Apparatus as defined in claim 13 in which said affixing means is pivotally mounted concentrically with said pivot of said folding means such that said affixing means and said folding means may rotate as a unit or independently.

15. Apparatus as in claim 14 respectively in which said means to affix said overlapping wrapping material is a heat seal device which incorporates a heating element covering substantially the area of the wrapping material to be affixed, said heating element mounted behind a layer of non-sticking material which contacts said overlapping tube to transfer heat to the tube substantially uniformly over said area of overlapping material at a modulated temperature to make an effective seal without "hot spots".

16. Apparatus as in claim 5, in which said means inside the tube open end projecting beyond the end of the bale further includes means to yieldably downwardly bias only said inside means that start at the two upper corners of the bale after said folding arms have at least partially closed against the bale end, said downward bias remaining as said inside means withdraws perpendicular to the bale end face, thus to cause the upper surface of the wrapping material to fold downwardly around the upper edge of the bale end face while tending to form an outside fold of the upper pleat of the tube projecting beyond the end of the bale.

17. Apparatus as in claim 16 in which said means inside the tube open end further includes means to yieldably upwardly bias only said inside means that start at the two lower corners of the bale, after said folding arms have at least partially closed against the bale end and after said inside means that start at the two upper corners of the bale have been downwardly biased, thus to allow the lower surface of the tube to fold upwardly around the lower edge of the bale end face while tending to form the final outside pleat of the lower fold of the wrapping material projecting beyond the end of the bale.

18. An apparatus as defined in claim 5 wherein two "ears" of excess tube looseness are created opposite said one open end when said bale is inserted fully into the tube, further comprising a pair of movable opposing thin plates each having a leading surface having a point and sloping back at about 45 degrees from each side of the point to form a smooth tuck when said plates move against said ear wherein said plates move parallel to the flat end of the bale when moved against and withdrawn from said ears.

* * * * *